US007712215B2

(12) United States Patent
Wang et al.

(10) Patent No.: US 7,712,215 B2
(45) Date of Patent: May 11, 2010

(54) METHOD FOR ASSEMBLING FLEXIBLE BUS CONNECTOR

(75) Inventors: Chien Chun Wang, Taoyuan (TW); Tung Chiung Kua, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 296 days.

(21) Appl. No.: 12/007,068

(22) Filed: Jan. 7, 2008

(65) Prior Publication Data

US 2008/0263847 A1 Oct. 30, 2008

(30) Foreign Application Priority Data

Apr. 27, 2007 (TW) ..... 96115028 A

(51) Int. Cl.
*H01R 43/20* (2006.01)
*H01K 1/00* (2006.01)

(52) U.S. Cl. ..... 29/876; 29/874; 29/879; 29/884; 439/79; 439/80; 439/81

(58) Field of Classification Search ..... 29/825, 29/874, 876, 879, 884; 439/79, 80, 81
See application file for complete search history.

(56) References Cited

U.S. PATENT DOCUMENTS

| | | | | | |
|---|---|---|---|---|---|
| 3,182,276 | A * | 5/1965 | Ruehlemann | ..... | 439/79 |
| 4,200,347 | A * | 4/1980 | Sinclair et al. | ..... | 439/70 |
| 5,626,483 | A * | 5/1997 | Naitoh | ..... | 439/74 |
| 5,768,777 | A * | 6/1998 | Lemke | ..... | 29/882 |
| 2008/0263847 | A1 * | 10/2008 | Wang et al. | ..... | 29/428 |

* cited by examiner

*Primary Examiner*—C. J Arbes
(74) *Attorney, Agent, or Firm*—Rosenberg, Klein & Lee

(57) ABSTRACT

A method for assembling a flexible bus connector is disclosed, which includes the following steps. The first is a preparing step. An insulative housing and a plurality of terminals are provided. The insulative housing defines an opening and a plurality of passageways, and forms an upper side wall, a lower side wall, and a rear wall corresponding to the opening. The second is an assembling step. Each terminal includes at least a contact portion, a support portion and a soldering portion. The contact portion and the support portion are located near the opening when assembled, and the soldering portion extending toward the rear wall of the insulative housing. The third is a positioning step. A lower end of the soldering portion is located on a position where the lower end is lower than an inner surface of the lower side wall of the insulative housing.

8 Claims, 5 Drawing Sheets

METHOD FOR ASSEMBLING FLEXIBLE BUS CONNECTOR

BACKGROUND OF THE INVENTION

1. Field of the Invention

The present invention relates to a method for assembling an electrical connector, and particularly to a method for assembling a flexible bus connector and preventing from damaging.

2. Related Art

A flexible bus connector is typically used to connect a flexible bus for communicating the flexible bus with a circuit board. A flexible bus connector of prior art comprises an insulative housing, and terminals inserted along slots into the insulative housing. The maximum height of the terminals is not larger than interior height of the insulative housing. So no deformation or distortion occurs during insertion of the terminals.

However, electronic products are prone to miniature profile. Correspondingly decreasing overall height inside the electronic products is desired. But it is necessary to guarantee strength of the terminals. For instance, U.S. Pat. No. 6,711,816 discloses a flexible bus connector, which reduces overall height of the connector and maintains strengths of the terminals by means of extending rotation support portions of the terminals beyond an insulative housing. In assembly, the terminals are inclined slightly rearward and downward. Flexible lower arms of the terminals bend inwardly. The rotation support portions of the terminals are mounted from a rear of the insulative housing into the insulative housing, and move forwardly. As the terminals are pushed to a predetermined position, the rotation support portions of the terminals return, by resiliency, to an original state, and are fixed.

As for the method described above, due to flexibility of the terminals, the rotation support portions, which are of height larger than inside height of the insulative housing, are assembled to the insulation housing and slide to be positioned, and then return by resiliency. But the terminals suffer from large distortion. As a result, the rotation support portions tend to be deformed or damaged during sliding for assembly. Especially, the rotation support portions normally support rotation of pressure elements. The distortion may make the pressure elements work abnormally.

SUMMARY OF THE INVENTION

Accordingly, a main object of the present invention is to provide a method for assembling a flexible bus connector, which prevents terminals from distortion and damage during assembly.

Another object of the present invention is to provide a method for assembling a flexible bus connector, which increases efficiency of connector assembly.

To achieve the above objects, the method for assembling a flexible bus connector according to the present invention comprises the following steps. The first is a preparing step. An insulative housing and a plurality of terminals are provided. The insulative housing defines an opening and a plurality of passageways, and forms an upper side wall, a lower side wall, and a rear wall corresponding to the opening. The second is an assembling step. Each terminal is inserted from the opening, along the upper side wall and the lower side wall, into the passageways of the insulative housing. Each terminal includes at least a contact portion, a support portion and a soldering portion. The contact portion and the support portion are located near the opening when assembled, and the soldering portion extend toward the rear wall of the insulative housing. The third is a positioning step. The soldering portion of each terminal is bent downwardly by mechanically machining. A lower end of the soldering portion is located on a position where the lower end is lower than an inner surface of the lower side wall of the insulative housing.

DESCRIPTION OF THE PREFERRED EMBODIMENTS

Figure 1:
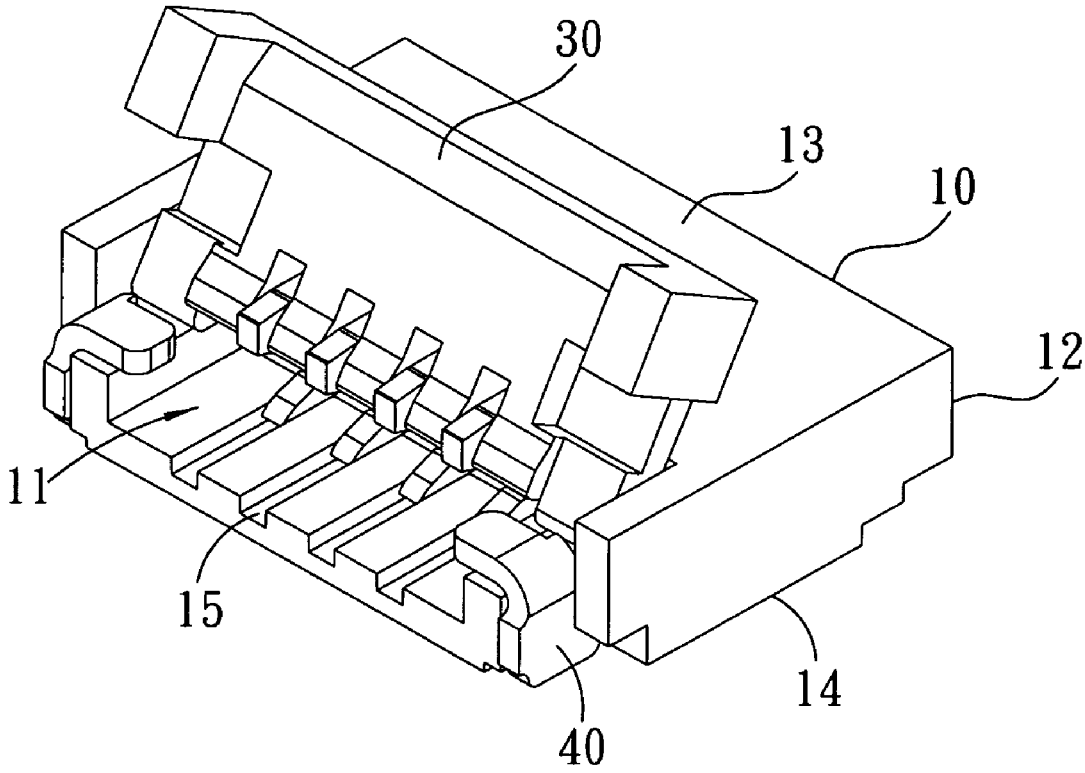
FIG. 1 is an assembled view of a flexible bus connector according to the present invention.
Figure 2:
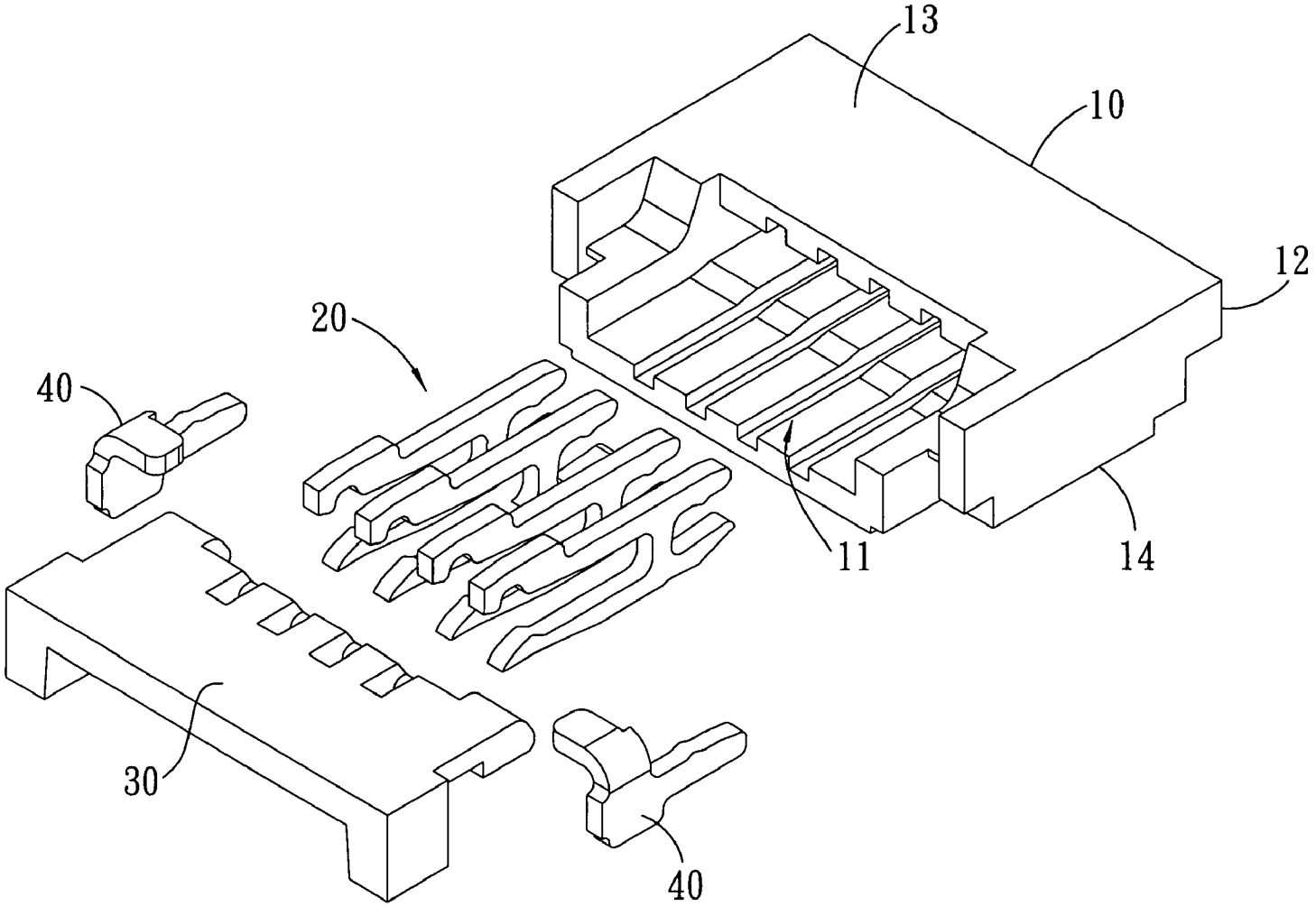
FIG. 2 is an exploded view of the flexible bus connector of FIG. 1.

Referring to FIGS. 1 to 3, a flexible bus connector in accordance with the present invention comprises a substantially rectangular insulative housing 10, a plurality of terminals 20, an upper cover 30 and a pair of pads 40.

The insulative housing 10 defines an opening 11 in a front thereof. The insulative housing 10 forms an upper side wall 13, a lower side wall 14, and a rear wall 12 at a rear thereof and corresponding to the opening 11. A plurality of passageways 15 are defined in the insulative housing 10 and are arrayed lengthwise. A stop portion 16 is formed on the rear wall 12 and between the upper side wall 13 and the lower side wall 14.

The terminals 20 are respectively assembled on the passageways 15 of the insulative housing 10. Each terminal 20 substantially has a lateral H shape, and includes a contact portion 21 and a support portion 22 at one side thereof and opposing to each other, and a soldering portion 23 and a positioning portion 24 at another side thereof and opposing to each other. The support portion 22 extends beyond other parts of the terminal 20. The overall height of other parts of the terminal 20 corresponds to a length between the upper side wall 13 and the lower side wall 14.

The upper cover 30 forms a rotation shaft 31 for fitting to the support portions 22 of the terminals 20. The upper cover 30 is capable of rotating freely about the opening 11 within a scope by interaction of the rotation shaft 31 and the support portion 22. In the case that the upper cover 30 is located on an open position, an end of a flexible bus 50 is inserted through the opening 11 and into the insulative housing 10. In the case that the upper cover 30 rotates downward to a close position, the upper cover 30 presses against the flexible bus 50. In such a way, the flexible bus 50 electrically contacts the contact portion 21 of each terminal 20, and disengagement therebetween is prevented.

In order to decrease the overall height, height of the support portion 22 of each terminal 20 is larger than inside height of the insulative housing 10. At the same time, the support portion 22 of each terminal 20 is slightly higher than the upper side wall 13. According to prior art, the terminal 20 has a certain of flexibility itself, so the support portion 22 tends to be distorted during the terminal 20 is assembled to the insulative housing 10. Moreover, in the case that an inner surface of the upper side wall 13 is not flat sufficiently, the support portion 22 is prone to be shocked and be distorted, obstructing the upper cover 30 in rotating.

Figure 3A:
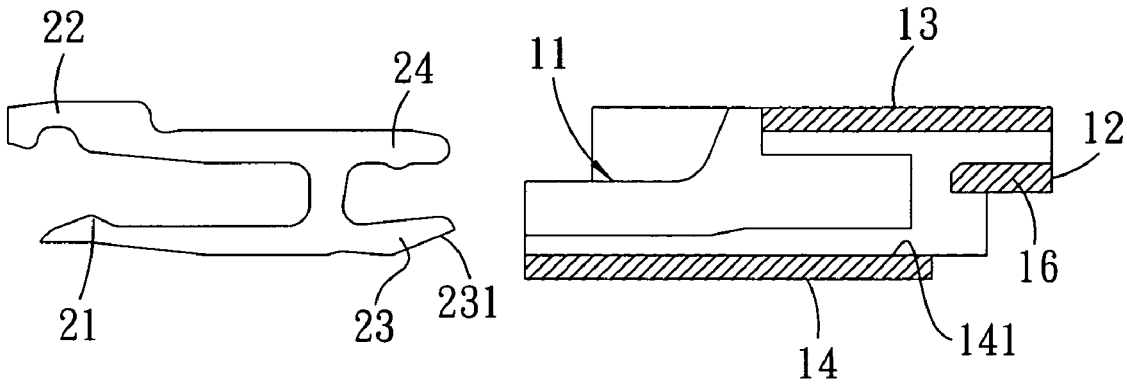
FIGS. 3A-3D exemplarily illustrate a method for assembling the flexible bus connector.
Figure 3B:
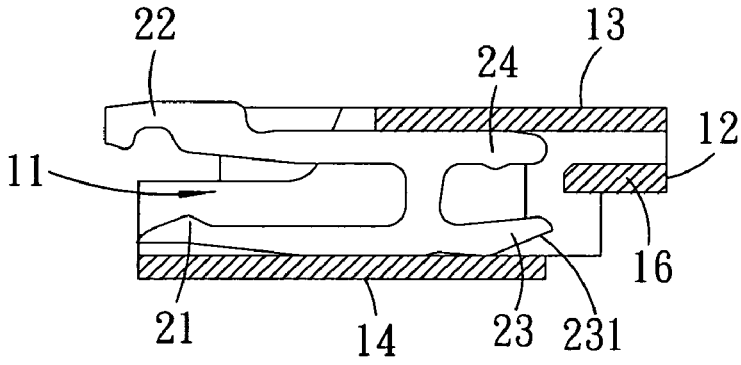
Figure 3C:
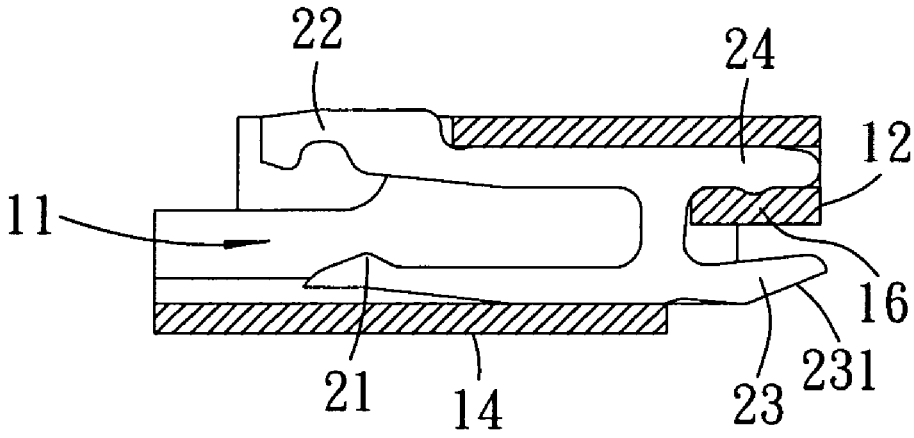
Figure 3D:
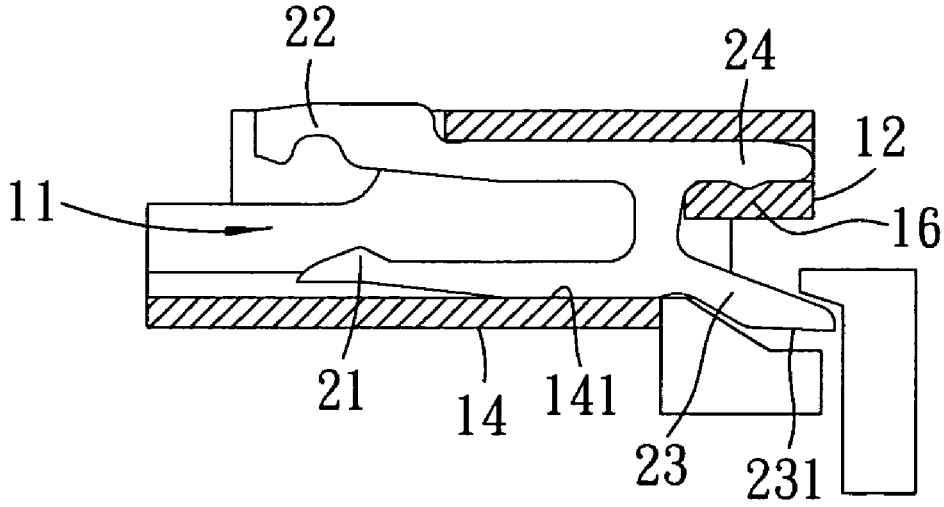
Figure 4:
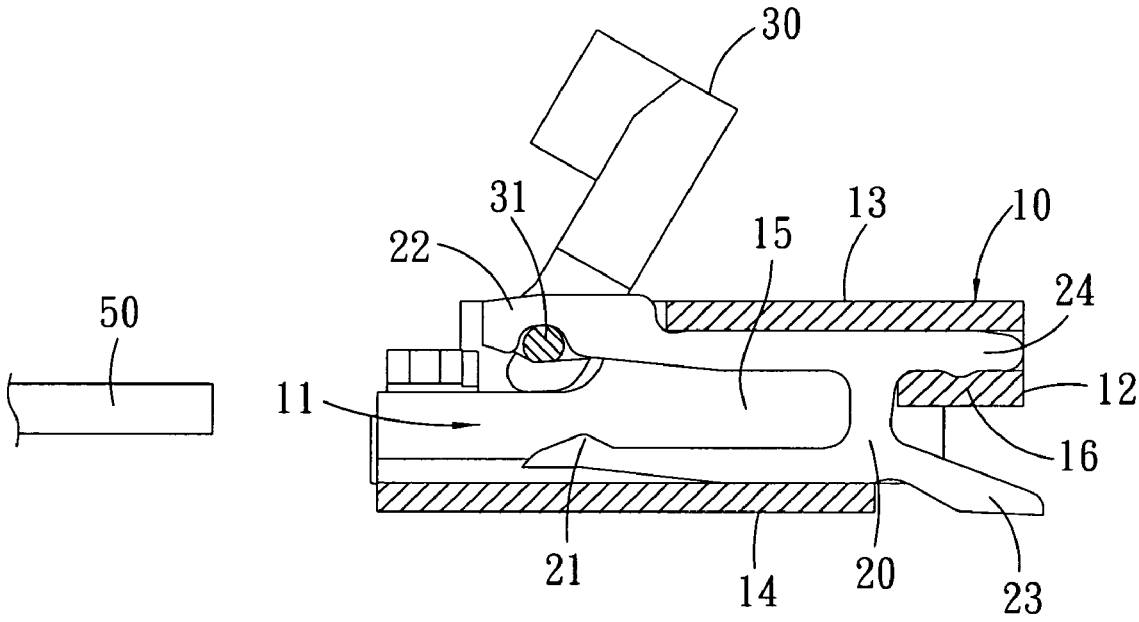
FIG. 4 is a cross-sectional view of the flexible bus connector of FIG. 1.

The present invention provides a method for assembling the connector, which prevents higher parts of the terminals 20 from distortion because of pressure. The method for assembling a flexible bus connector comprises the following steps. The first is a preparing step. Referring to FIG. 3A, an insulative housing 10 and a plurality of terminals 20 are provided. Except for the support portion 22 of each terminal 20, the height of each terminal 20 is substantially as the same as the length between the upper side wall 13 and the lower side wall 14. Referring to FIGS. 3B and 3C, the soldering portion 23 of each terminal 20 is brought to be inserted from the opening 11 of the insulative housing 10, along the upper side wall 13 and the lower side wall 14, and into the passageway 15, and extends toward the rear wall 12 of the insulative housing 10 to be positioned. The positioning portion 24 is fixed between the upper side wall 13 and the stop portion 16, reliably retaining each terminal 20. The soldering portion 23 substantially extends rearward beyond the lower side wall 14. The support portion 22 is positioned in the opening 11, and is located at generally the same height as the upper side wall 13. The third is a positioning step, as shown in FIG. 3D. The soldering portion 23 is bendable in such a way that a lower end 231 of the soldering portion 23 does not contact the lower side wall 14 of the insulative housing 10. In one embodiment, the soldering portion 23 is substantially bent downwardly by mechanically machining. A lower end 231 of the soldering portion 23 remains a position where the lower end 231 is lower than an inner surface of the lower side wall 14. Generally, the lower end 231 of the soldering portion remains a position where the lower end 231 and an outward surface of the lower side wall 14 are at a common plane for soldering to a circuit board.

The upper cover 30 is assembled on the opening 11 of the insulative housing. The rotation shaft 31 of the upper cover 30 and the support portion 22 of each terminal 20 support each other, making the upper cover 30 able to rotate within a scope. Notably, the step of assembling the upper cover 30 may follow or be followed by the positioning step.

During assembly, the support portion 22 of each terminal 20 is guarded against distortion since the support portion 22 does not pass through interior of the insulative housing 10. Each terminal 20 interferentially fits to the upper side wall 13 and the lower side wall 14. Besides this, the positioning portion 24 of each terminal 20 is interferentially retained on the stop portion 16, enhancing retention of the terminal 20 and increasing efficiency of the assembly.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A method for assembling a flexible bus connector, comprising:

A preparing step: providing an insulative housing and a plurality of terminals, the insulative housing defining an opening and a plurality of passageways, and forming an upper side wall, a lower side wall, and a rear wall corresponding to the opening;

an assembling step: each terminal being inserted from the opening, along the upper side wall and the lower side wall, into the passageways of the insulative housing, each terminal including at least a contact portion, a support portion and a soldering portion, the contact portion and the support portion being located near the opening when assembled, and the soldering portion extending toward the rear wall of the insulative housing; and a positioning step: the soldering portion of each terminal being bent downwardly by mechanically machining, a lower end of the soldering portion being located on a position where the lower end is lower than an inner surface of the lower side wall of the insulative housing.

2. The method for assembling a flexible bus connector as recited in claim 1, wherein a step of assembling the upper cover follows or is followed by the positioning step, the step of assembling the upper cover comprising: assembling the upper cover onto the support portion of each terminal in such a way that the upper cover is able to rotate freely about the opening of the insulative housing.

3. The method for assembling a flexible bus connector as recited in claim 1, wherein the soldering portion of each terminal projects beyond the lower side wall of the insulative housing, and wherein the soldering portion is bendable in such a way that a lower end of the soldering portion does not contact the lower side wall of the insulative housing.

4. The method for assembling a flexible bus connector as recited in claim 1, wherein the support portion of each terminal is located at the same height as the upper side wall of the insulative housing.

5. The method for assembling a flexible bus connector as recited in claim 1, wherein a stop portion is formed on the rear wall of the insulative housing.

6. The method for assembling a flexible bus connector as recited in claim 5, wherein each terminal forms a positioning portion, which is fixed between the stop portion and the upper side wall of the insulative housing for retaining the terminal.

7. The method for assembling a flexible bus connector as recited in claim 1, wherein in the assembling step, the soldering portion of each terminal is inserted from the opening of the insulative housing.

8. The method for assembling a flexible bus connector as recited in claim 1, wherein the support portion of each terminal is substantially higher than an inside height of the insulative housing.

* * * * *